United States Patent [19]

Lien

[11] Patent Number: 4,628,291

[45] Date of Patent: Dec. 9, 1986

[54] FULL RANGE OIL EXPULSION FUSE

[75] Inventor: Wayne W. Lien, Waukesha, Wis.

[73] Assignee: RTE Corporation, Waukesha, Wis.

[21] Appl. No.: 736,959

[22] Filed: May 22, 1985

[51] Int. Cl.[4] ..... H01H 85/02

[52] U.S. Cl. ..... 337/203; 204/249; 204/250

[58] Field of Search ..... 337/203, 204, 217, 249, 337/250, 246, 248, 280, 282

[56] References Cited

U.S. PATENT DOCUMENTS 4,205,295 5/1980 Mahieu ..... 337/204

*Primary Examiner*—Harold Broome

*Attorney, Agent, or Firm*—Andrus, Sceales, Starke & Sawall

[57] ABSTRACT

An oil expulsion fuse having a pair of contacts solidly secured to the ends of a high strength outer insulating tube. A resilient non-conducting inner sleeve is mounted within the bore of the insulating tube and contact assembly, the sleeve and tube being closely fit to each other. A fusible link is assembled in the bore of the resilient sleeve secured to the contact ends by fuse clamps. The fusible link includes a support tube also composed of a resilient non-conductive material which together with the inner sleeve absorb and trap high energy fuse link particles during a fusing operation.

18 Claims, 3 Drawing Figures

FULL RANGE OIL EXPULSION FUSE

BACKGROUND OF THE INVENTION

Under oil expulsion fuses are generally used in high voltage systems to protect the electric devices from fault currents. The expulsion fuse is ideally suited for use in series with backup current limiting fuses since it can be used to provide current interruption under low fault conditions without operation of the more costly limiting fuse. Low fault current clearing had until now to some extent been limited by the absence of controlled pressures within the expulsion fuse as described in my copending application Ser. No. 134,966 entitled "High Current Under Oil Expulsion Fuse", now U.S. Pat. No. 4,320,375. Fault current clearing in all current ranges has also been limited by the inability to dissipate the energy imparted to the fuse element assembly and its surrounding tubular support assembly.

SUMMARY OF THE INVENTION

The under oil expulsion fuse of the present invention increases the maximum interrupting capability of an expulsion fuse from 150% to 200% of the existing rating. The expulsion fuse described herein when used in conjunction with the pressure retention chamber described in the copending application Ser. No. 134,966 entitled "High Current Under Oil Expulsion Fuse", now U.S. Pat. No. 4,320,375, has the capability of clearing approximately 8,000 amps RMS symmetrical at 8.3 kV while standard fuses have a normal capability of clearing 3,500 amps. The increased capability is achieved by employing resilient tubes in the design of the fuse element and its surrounding fuse holder.

The present state of the art designs consist of a fuse having a set of contacts held in place by an insulating high strength outer tube assembly. That assembly has a ⅜" diameter bore through which a fuse element assembly is installed. The fuse element assembly normally consists of a ⅜" outside diameter tube with a 3/16" diameter bore, with the fuse element installed in the bore.

In this design an inner layer of resilient dielectric material is installed between the fuse element assembly and the high strength outer tube assembly. The inner layer acts as a buffer zone. Upon fusing of the element, the shock wave, caused by the element vaporizing along with the oil in the bore of the fuse element assembly, is partially absorbed by the liner of the fuse element assembly.

The fuse energy is then, in the state of the art design, imparted directly to the strong but brittle high strength outer tube assembly. However, in this design the fusing energy from the fuse element assembly is imparted to the inner resilient buffer layer where more energy is absorbed. The shock wave is being attenuated and made more uniform so that the ultimate force transmitted to the high strength outer layer is reduced and the rate of energy transfer is reduced. The overall result is that with the buffer zone or layer the fuse cartridge can withstand a much higher initial shock wave without mechanical destruction.

Secondly, upon fusing, the element explodes sending molten fuse particles and hot gas in all directions. The particles that strike the liner of the fuse element assembly will in some cases have enough energy to enter the liner material. As the particles and gas penetrate the liner material they melt the material, giving up some energy until ultimately they are stopped. As the particles pass through the liner material the now melted liner material can and usually does flow back together and solidifies leaving little trace that particles have passed. The very high energy particles will have enough power to drive through the liner of the fuse element assembly and herein lies the invention. If sufficient numbers of particles get through the fuse element liner and are not in some way neutralized, they, being conductive and being surrounded by conductive gas, will allow an arc to establish between the two end contacts. To achieve neutralization the resilient inner buffer layer is therefore provided, centered between the contacts. During the fusing operation, the pressure of the fusing operation in the bore of the fuse element assembly, will force the liner of the fuse element to be in intimate contact with the inner resilient layer of the outer tube assembly. Because of this close contact the particles leaving the fuse element liner will directly enter the resilient layer where they will ultimately be stopped and entombed by the resilient material.

The invention is designed such that the majority of particles are stopped and held by the sleeve or liner of the fuse element which will then be replaced when refusing the unit. The high energy particles and gas clouds are trapped in the resilient sleeve of the outer tube assembly. The fuse assembly liner is such that the bore area will soften during the heat of the fusing operation. The softened bore area will then become pitted and pocketed by the particle bombardment and gas pressure. This surface configuration serves to increase the surface area of the bore and ultimately the electrical creep distance between the end contacts after the fuse clearing operation is complete. Near the end of the fuse clearing operation hot gases are being blasted down the bore of the fuse liner. These gases sweep clean the surface of the liner craters which enhances the ability of the liner to withstand voltage. When the clearing operation is complete, oil returns to the fuse bore cooling the inner surface, solidifying it again, and trapping the gas and particles that were in the sleeve surface material.

There are two alternate forms of this design. The first is to increase the wall thickness of the fuse link assembly liner to the point where it alone can absorb and attenuate the shock wave and also it alone can capture and absorb enough of the impacting high energy fuse particles and associated gas to prevent the electrical dielectric breakdown between the end contacts. The second is to increase the thickness of the inner resilient layer by decreasing its inner diameter down to the inner diameter of the fuse element assembly liner thereby eliminating the liner. The cartridge could then be refused by installing a fuse link alone or the unit could be considered as non-refusible.

BRIEF DESCRIPTION OF THE DRAWINGS

The drawings illustrate the best mode presently contemplated of carrying out the invention.

In the drawings.

DETAILED DESCRIPTION

Figure 1:
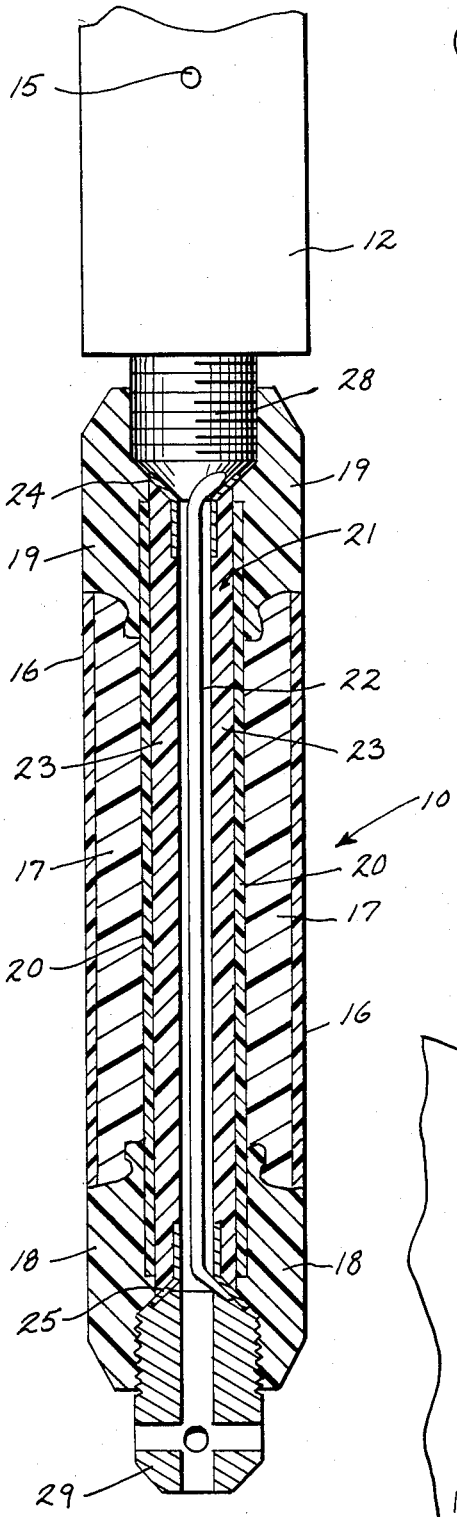
FIG. 1 is a side view in elevation with parts broken away and in section illustrating a bay-o-net stab incorporating an expulsion fuse in accordance with the principles of the present invention.
Figure 2:
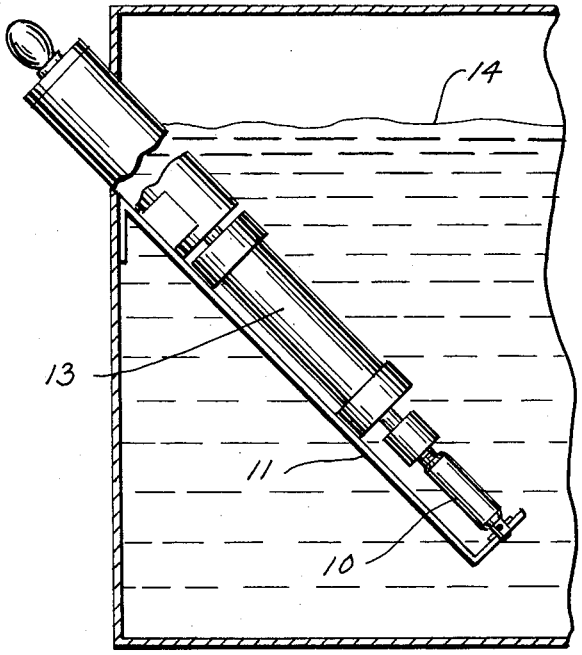
FIG. 2 is a side view in elevation illustrating an under oil current limiting fuse incorporating an expulsion fuse in accordance with the principles of the present invention.

An expulsion fuse 10 is mounted either on the end of a bay-o-net stab 12 as shown in FIG. 1, on the end of a current limiting fuse 13 as shown in FIG. 2, or by a support fixture to hold its position as required for proper operation. The combined fuse 10 and mounting fixture 12 or 13 are generally installed in an enclosure filled with an insulating fluid 14 such as oil to insulate and cool the enclosed electrical apparatus. The fuse 10 must be totally immersed in oil at least to above a vent hole 15 in the fuse mounting fixture 12.

The fuse 10 according to the present invention generally includes a fuse having an outer jacket 16 which serves as a sliding surface upon which contacts to the fuse can slide without being abraded and without leaving conductive particles which could cause a conductive path. Secondly, the outer jacket 16 may be made of a material which gives off arc extinguishing gas when contacted by an arc which is advantageous if the fuse is used in a bay-o-net type loadbreak application. In the preferred design this material is polyester. Below the outer surface is a high strength glass wound epoxy sleeve 17 having electrically conductive contacts 18, 19 at both ends. The glass epoxy sleeve 17 covers a resilient inner layer or tube 20 made of a material such as a fluorocarbon polymer or fluoroplastic.

Fluoroplastics are defined by the American Society for Testing and Materials as plastics based on polymers made from monomers containing one or more atoms of fluorine or copolymers of such monomers with other monomers, the fluorine-containing monomer or monomers being in the greatest amount by mass (ASTM D-883). Fluoroplastics are made by free radical initiated polymerization or copolymerization of the monomers. Fluorocarbon plastics, those made from perfluoro monomers, include polytetrafluoroethylene (PTFE), fluorinated ethylene-propylene copolymer (FEP), and perfluoroalkoxy resin (PFA). Another fluoroplastic is ethylene-tetrafluoroethylene copolymer (ETFE). PTFE is the most common fluoroplastic utilized, and is available from the DuPont Company under the trademark Teflon.

In the preferred design Teflon is used as the resilient material for inner layer 20. The function of this inner layer 20 is two-fold. First, it must absorb some of the shock due to fuse clearing and transmit the pressure to the high strength glass epoxy sleeve 17. Second, layer 20 must absorb and trap the high velocity fuse particles being blasted into it during the fusing operation.

A replaceable fuse link assembly 21 is located in the bore of the resilient tube 20. The fuse link assembly consists of an expulsion fuse link 22 which will begin fusing according to a predetermined fuse melt characteristic. The link 22 is installed in a fuse tube 23 which is a resilient sleeve. Fuse link contact ferrules 24, 25 may be installed on the ends of the tube 23 to connect the fuse link 22 to a pair of corresponding end contacts 28 and 29 which in turn are connected to a fuse holder 11. The fuse link 22 is electrically connected to the contact ferrules usually by a solder joint. The fuse tube 23 serves several functions. First, it holds and protects fuse link 22 from damage due to handling. Second, it provides a nonconductive insulating bore that gives off arc extinguishing gas during the fusing operation. The tube 23 also absorbs much of the shock wave and pressure produced when fuse link 22 explodes and burns back during fusing, and transmits a more uniform force to the inner layer 20 and glass sleeve 17. A major function of fuse tube 23 is to admit, trap and contain some of the high energy products from the fusing of the link 22. These products consist of molten fuse link bits, solids and gases caused by the vaporization of the link 22 and the insulating liquid in the fuse tube bore.

Figure 3:
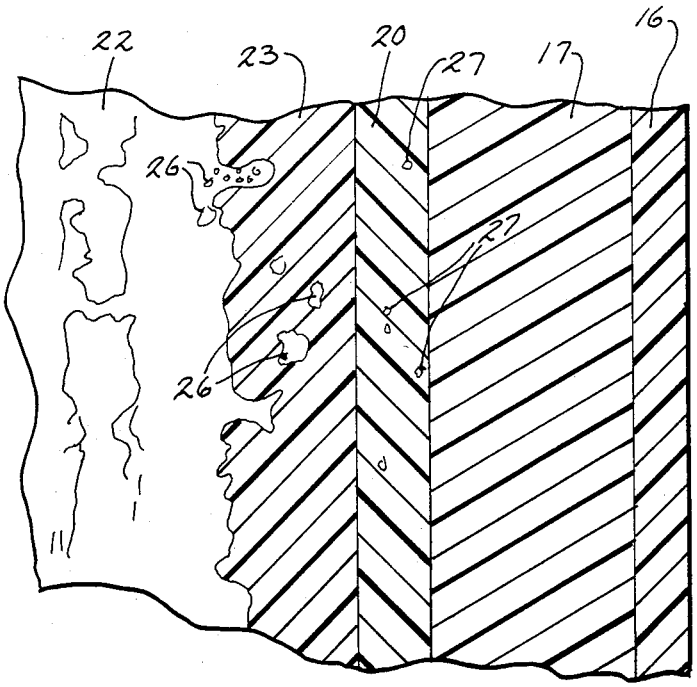
FIG. 3 is a fragmentary enlarged microscopic schematic view illustrating a fusing operation.

FIG. 3 shows a microscopic sketch of what occurs during fusing. The molten fuse link pieces 26 are blasted into the fuse tube 23. Along with some of the gas and other arc products the heat from the arc will soften the surface area of the fuse tube 23. Testing shows this softened area to extend about 0.040" into the material of the tube 23. When the fuse link particles 26 and gas come in contact with the fuse tube 23 they continue into the material. This hot particle cloud melts the fuse tube material as it passes. Once the cloud is passed, the fuse tube material flows back together and solidifies leaving very little trace of its path.

Particle clouds 27 with very high energy may go completely through the fuse tube 23 and on into the resilient inner layer 20 where they are trapped.

In the preferred design both the fuse tube 23 and resilient inner layer 20 are made of Teflon. The outside diameter of layer 20 is 0.5" and its inside diameter is $\frac{3}{8}$". The fuse tube 23 has an outside diameter of $\frac{3}{8}$" and a bore of 3/16". With this configuration most of the gas clouds, 90% or more, are trapped in the wall of fuse tube 23. In that way, the majority of the contaminated Teflon is thrown away when fuse link replacement is made. The $\frac{1}{2}$" outside diameter of the inner layer 20 was determined to be the optimum diameter to allow sufficient wall thickness of the resilient material to prevent the highest energy particles from passing all the way through and striking the glass wound epoxy sleeve 17.

It is clear, therefore that this is a unique design in that the fuse tube 23 and resilient sleeve 20 are used to absorb and equalize the initial shock and following pressure of the fusing operation. Tube 21 and sleeve 20 actually absorb and trap the high energy fuse link particles which have in state of the art fuses caused limitations of the maximum fuse interrupting current. This design eliminates the restrike failures caused by fuse link particles and gas clouds piercing the fuse tube 21, contaminating the outer surface of the fuse tube 21.

Various modes of carrying out the invention are contemplated as being within the scope of the following claims particularly pointing out and distinctly claiming the subject matter which is regarded as the invention.

I claim:

1. An under oil expulsion fuse, comprising a tubular assembly having an electrically conductive contact on each end, a fuse link supported within the assembly being electrically connected to each of said contacts, and support for said fuse link which includes a resilient material with a bore opening to accept the fuse link, said tubular assembly includes an arc resistant surface layer, a high strength intermediate layer of non-conducting material which secures the end contacts in place and contains the forces developed during fuse clearing, and an inner layer of reilient non-tracking, non-conducting material with the ability to absorb and contain particulate matter impacted upon it.

2. The fuse, according to claim 1 wherein the high strength layer is a glass reinforced epoxy.

3. The fuse according to claim 1 wherein the resilient, non-conducting material is a fluorocarbon polymer.

4. The fuse according to claim 3 wherein the polymer is a polytetrafluoroethylene.

5. An under oil expulsion fuse, comprising a tubular assembly having an electrically conductive contact on each end, said tubular assembly including a resilient, non-conductive inner layer and an insulating outer layer of sufficient strength to withstand the forces developed during a fusing operation, and a fuse link supported within the tubular assembly being electrically connected to each of said contacts and a fuse support tube for said link composed of a resilient non-conducting material.

6. The fuse according to claim 5 wherein the resilient inner layer is a fluorocarbon polymer.

7. The fuse according to claim 5 wherein the resilient inner layer is a polytetrafluoroethylene.

8. The fuse according to claim 5 wherein the fuse support tube is a fluorocarbon polymer.

9. The fuse according to claim 5 wherein the fuse support tube is a polytetrafluoroethylene.

10. The fuse according to claim 5 wherein the fuse support tube has two conductive end members, to which a fuse link is electrically connected through the fuse support tube bore, which end members provide the electrical connection between the fuse end contacts and the fuse link.

11. The fuse according to claim 5 wherein the tubular assembly includes an arc resistant surface layer.

12. The fuse according to claim 5 wherein the tubular assembly includes an inner layer of resilient non-tracking, non-conducting material with the ability to absorb and contain particular matter impacted upon it.

13. The fuse according to claim 10 wherein the resilient inner layer is a fluorocarbon polymer.

14. The fuse according to claim 13 wherein the resilient inner layer is a polytetrafluoroethylene.

15. The fuse according to claim 5 wherein the resilient, non-conductive inner layer and the resilient non-conductive fuse support tube are combined as one piece.

16. The fuse according to claim 15 wherein the resilient, non-conducting material is a fluorocarbon polymer.

17. The fuse according to claim 16 wherein the polymer is a polytetrafluoroethylene.

18. An under oil expulsion fuse, comprising a tubular assembly having an electrically conductive contact on each end, a fuse link supported within the assembly being electrically connected to each of said contacts, and support for said fuse link which includes a resilient material with a bore opening to accept the fuse link, said support and fuse link may be withdrawn from the tubular assembly for replacement, and said support has two conductive end members, to which the fuse link is electrically connected through the bore of the support, which conductive end members provide the electrical connection between the fuse end contacts and the fuse link.

* * * * *